US006019687A

United States Patent [19]

Blowers

[11] Patent Number: 6,019,687

[45] Date of Patent: Feb. 1, 2000

[54] GOLF CLUB HAVING A HOLLOW AIR FILLED HEAD

[76] Inventor: Alden J. Blowers, 800 W. First St., #705, Los Angeles, Calif. 90012

[21] Appl. No.: 09/104,629

[22] Filed: Jun. 25, 1998

[51] Int. Cl.[7] ..... A63B 53/04

[52] U.S. Cl. ..... 473/326; 473/332; 473/345

[58] Field of Search ..... 473/219, 324, 473/329, 334, 333, 345, 346, 349, 287, 256, 226, 332, 326

[56] References Cited

U.S. PATENT DOCUMENTS

| | | |
|---|---|---|
| 1,831,255 | 11/1931 | Menzies . |
| 2,432,450 | 12/1947 | Sears . |
| 3,993,314 | 11/1976 | Harrington et al. . |
| 5,064,197 | 11/1991 | Eddy . |
| 5,082,279 | 1/1992 | Hull . |
| 5,100,206 | 3/1992 | Feng . |
| 5,178,392 | 1/1993 | Santioni . |
| 5,263,713 | 11/1993 | Taylor et al. . |
| 5,540,625 | 7/1996 | Koch et al. . |
| 5,632,693 | 5/1997 | Painter . |
| 5,788,587 | 8/1998 | Tseng . |

FOREIGN PATENT DOCUMENTS

| | | | |
|---|---|---|---|
| 124401 | 6/1947 | Australia . | |
| 24274 | 11/1898 | United Kingdom . | |
| 2 200 560 | 8/1988 | United Kingdom | 273/171 |
| 2 247 628 | 3/1992 | United Kingdom . | |

*Primary Examiner*—Sebastiano Passaniti
*Attorney, Agent, or Firm*—Morland C. Fischer

[57] ABSTRACT

A golf club, such as a conventional metal/wood driver, including a hollow club head, an elongated shaft, and a hollow hosel joined at one end thereof to the club head and connected at the opposite end to the shaft. A normally closed air valve is located inside the hollow hosel. Prior to connecting the shaft to the hosel, the normally closed air valve in the hosel is momentarily opened so that a supply of fluid (e.g. air) under pressure can be delivered to the interior of the club head through the hosel. By virtue of the foregoing, the hollow club head will be filled with air so as to become less susceptible to compression during its impact with a golf ball, whereby a harder striking force will be imparted to the golf ball to enable the golfer to drive the ball a longer distance. A pressure gauge and a pressure relief valve are carried by the hollow club head to provide the golfer with a visual indication of the fluid pressure at the interior of the head and avoid over-pressurized conditions therewithin.

11 Claims, 2 Drawing Sheets

GOLF CLUB HAVING A HOLLOW AIR FILLED HEAD

BACKGROUND OF THE INVENTION

1. Field of the Invention.

This invention relates to a golf club (e.g. a metal/wood driver) including a hollow club head and a volume of fluid (e.g. air) that is stored, under pressure, in the hollow club head so that the club head will be less susceptible to compression during its impact with a golf ball, whereby a harder striking force will be imparted to the golf ball to enable a golfer to drive the ball a longer distance.

2. Background Art.

Golfers are regularly attempting to improve their play during a game of golf. For example, on a relatively long hole, a driver is used with the hopes that the golfer will hit the ball a long distance off the tee or down the fairway. In this regard, there are performance enhancing drivers available that are characterized as being of light weight, impact resistant and manufactured from a metal (e.g. titanium or the like). Such drivers have a hollow club head and commonly referred to by golfers as a metal/wood.

As will be recognized by those who play the game of golf, it is highly advantageous for the golfer to be able to increase the length of his tee shot or fairway drive even by a relatively short distance. Outside of improving his form and/or using an entirely new driver design, there is little the golfer can do to increase the total distance traveled by his golf ball.

Therefore, it would be desirable to be able to use a conventional metal/wood driver which employs conventional manufacturing technology to provide a harder striking surface during impact with a golf ball so that the golf ball will travel a longer distance.

SUMMARY OF THE INVENTION

A golf club is disclosed that is commonly known as a metal/wood and typically used by a golfer to drive a golf ball from a tee or fairway. The driver includes a hollow club head, an elongated shaft, and a hollow hosel that is joined at one end thereof to the hollow club head and connected at the opposite end to the shaft. Prior to connecting the shaft to the hosel to complete the assembly of the metal/wood driver, a normally closed air valve is disposed at a suitable location within the hosel so as not to interfere with the ultimate receipt of the shaft by the hosel. The air valve has a set of screw threads extending therearound which is mated to a corresponding set of screw threads inside the hosel. Also prior to connecting the shaft, the normally closed fluid valve is momentarily opened, and a supply of fluid (e.g. compressed air) under pressure passes through the hosel to fill the hollow club head. When the club head is filled with a suitable volume of air at a desired pressure, the fluid valve is allowed to close in order to trap the air at the interior of the hollow club head. By virtue of the foregoing, the hollow club head will be less susceptible to compression during its impact with a golf ball, whereby a harder striking force will be imparted to the golf ball to enable a golfer to drive the ball a longer distance. A pressure gauge is mounted at the top of the club head to lie in fluid communication with the interior of the hollow club head and provide the golfer with a visual indication of the pressure within the head. A normally closed pressure relief valve is mounted at the heel of the hollow club head to avoid over-pressurized conditions therewithin.

To prevent air from leaking out of the hollow club head to the atmosphere, the interior of the club head may be covered by a liquid sealer that is sprayed through the hollow hosel and/or an opening in the bottom of the club head before the usual sole plate is affixed to the club head to close the hole therethrough. In the alternative, an inflatable balloon can be located at the interior of the hollow club head to form an envelope for trapping the air under pressure that is supplied to the club head via the hosel. In this case, an open neck of the balloon is coupled to the fluid valve so that the balloon will be inflated with the air that is delivered through the hollow hosel when the air valve is momentarily opened.

DETAILED DESCRIPTION

Figure 1:
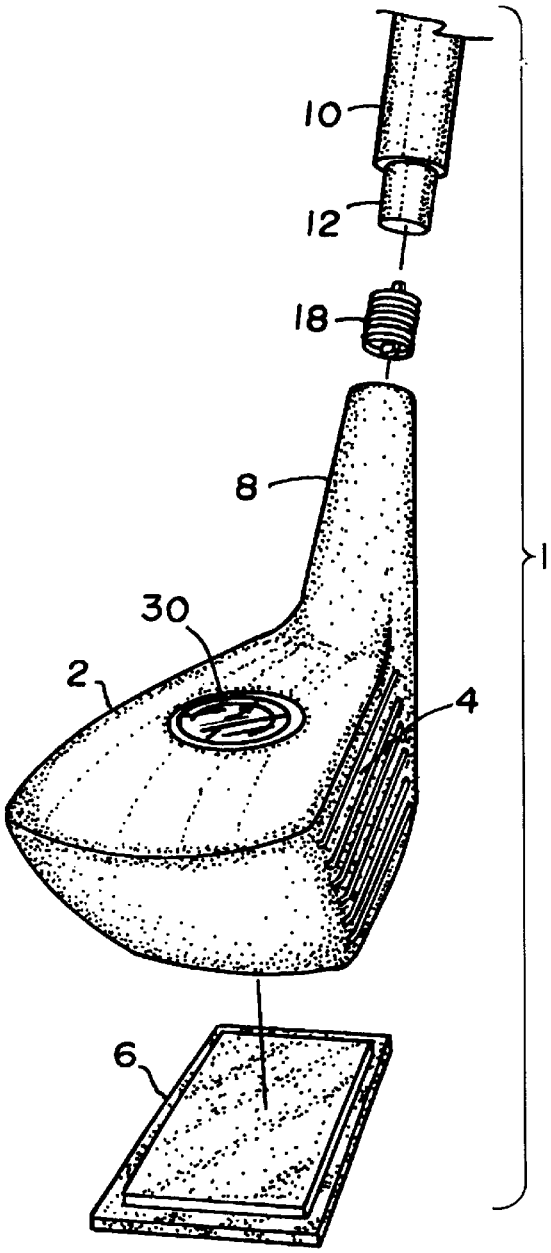
FIG. 1 shows an exploded view of the golf club having a hollow air filled head which forms the present invention.
Figure 2:
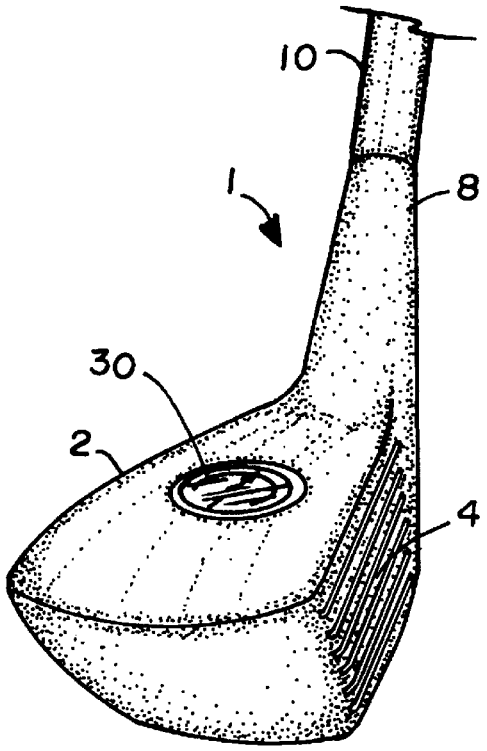
FIG. 2 shows the golf club of FIG. 1 in the assembled configuration.

Referring to the drawings, FIGS. 1 and 2 illustrate a golf club 1 of the type to which the present invention is related. More particularly, the golf club 1 is known among golfers as a metal/wood and is typically used by a golfer to drive a golf ball a relatively long distance off a tee or down a fairway. In this regard, the metal/wood golf club 1 includes a driving head 2 that is formed from a metallic (e.g. titanium) casting of hollow construction (best shown in FIGS. 3 and 4). One side of the head 2 is flat to form an impact surface 4 for striking the golf ball during the golfer's golf stroke. The bottom of the head 2 is open, and a metallic sole plate 6 is secured (e.g. soldered or welded) to the head 2 to close the open bottom thereof.

The top of the hollow club head 2 narrows to form the usual hollow hosel 8 to which a hollow shaft 10 is connected. That is, the hosel 8 is tapered so as to be joined at the bottom end thereof to the hollow interior of the club head 2 and connected at the opposite top end to the shaft 10. The hollow shaft 10 of club 1 is an elongated generally cylindrical rod that is covered by a hand grip (not shown) at one end and terminates at a connecting plug 12 (best shown in FIG. 1) that projects from the opposite end. In the assembled golf club configuration of FIG. 2, the connecting plug 12 of the shaft 10 is snugly received by and anchored within the top end of the hosel 8, whereby to interconnect the club head 2 with the shaft 10.

Figure 3:
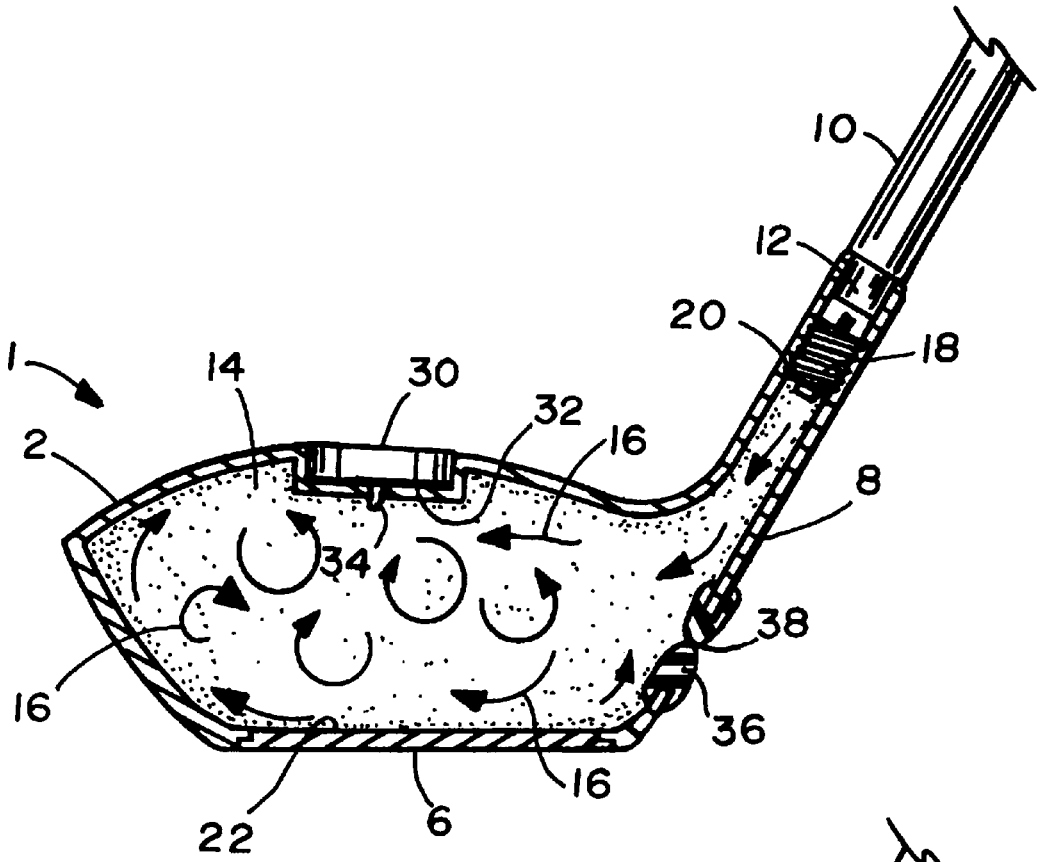
FIG. 3 is a cross section showing the golf club of FIG. 2 having a hollow head filled with air under pressure.

In accordance with the present invention, and turning now to FIG. 3 of the drawings, the hollow interior 14 of the driving head 2 of golf club 1 is filled with a supply of fluid under pressure. By way of example, the fluid with which the hollow head 2 of golf club 1 is filled is a gas such as, for example, compressed air 16 that is stored in a pressurized tank (not shown).

To this end, a screw threaded, normally closed fluid (i.e. air) valve 18 is located inwardly of and affixed to the top end of the hollow hosel 8 of club head 2. One such air valve 18 that is suitable for use in the present invention is a conventional tire valve manufactured by Bridge Products, Inc. and available from Pep Boys Auto Parts Stores.

In order to accommodate the threaded air valve 18, the hosel 8 is provided with a set of complementary screw threads 20 extending around the interior thereof. It should be recognized that the screw threads 20 must be particularly located within the hosel 8 so that the air valve 18, when attached to the hosel 8, will not interfere with the receipt of the connecting plug 12 of the shaft 10 within the top end of hosel 8. Therefore, the threaded air valve 18 will be installed at the threaded hosel 8 of club head 2 prior to the connection of the shaft 10 to the hosel 8 to complete the final assembly of the golf club 1.

After the threaded air valve 18 is installed, as indicated above, but before the shaft 10 is connected to the hosel 8, the hollow interior 14 of club head 2 is filled with a supply of gas under pressure (e.g. compressed air 16). The foregoing may be accomplished by an air hose (not shown) or other suitable means of delivery that is mated to the air valve 18 so as to cause the normally closed air valve to be momentarily opened to establish an air flow path through the air valve 18 and into the interior 14 of club head 2.

Once the club head 2 is filled with compressed air 16, the air valve 18 is allowed to return to its normally closed condition to prevent air from leaking out of the club head to the atmosphere. In this same regard, a liquid sealer 22 may be applied along the interior of the club head 2 to more reliably prevent the escape of air from the interior 14 of club head 2. By way of example, a commercially available sealer that can be used to cover the hollow interior 14 of club head 2 is that manufactured by Behr Process Corporation under the trademark Sealtite. In this case, the liquid sealer 22 is sprayed into the interior 14 of club head 2 prior to affixing the sole plate 6 and/or prior to attaching the air valve 18 in hosel 8.

Although the air valve 18 has been shown and described as being located within the hosel 8 of golf club 1, it is to be understood that the air valve may communicate with the hollow interior 14 of club head 2 at other locations. By way of example, the air valve 18 could also be located within the hollow shaft 10 or through a wall of the club head 2.

The club head 2 of golf club 1 can be selectively filled with a volume of air at any desired pressure in order to meet the objectives of the golfer. The air pressure within the club head 2 can be measured by attaching a conventional pressure gauge (not shown) to the air valve 18. When the club head 2 is suitably filled with air to the desired pressure, the gauge is removed, and the shaft 10 is connected to the top end of hosel 8 above the air valve 18. At this point, the golf club 1 will be fully assembled and ready for use by a golfer in the same manner that a conventional metal/wood driver would be used, but without the improvement and advantage of the present invention.

In cases where a golfer wishes to conveniently monitor the pressure within the club head 2 on a continuous basis, a conventional pressure gauge 30 is affixed to the top of the club head. That is to say, rather than making pressure checks at the air value 18 located in hosel 8 by first having to separate the shaft 10 from the hosel 8, the golfer may accurately determine the pressure within the hollow head 2 of golf club 1 by simply inspecting the pressure gauge 30. By virtue of the foregoing, the golfer can quickly and easily check his club head for leaks so as to be able to select the most suitable club from a set of clubs depending upon the pressures indicated at the respective pressure gauges and the specific needs of the golfer (e.g. driving from a tee or the fairway).

The pressure gauge 30 is preferably located in a recess 32 formed at the top of the club head 2 of golf club 1 so that the pressure gauge 30 will lie substantially flush against the club head. In the alternative, the pressure gauge could be located at the top of the shaft 10 so as to communicate with the hollow interior 14 of club head 2 via the hollow hosel 8 and shaft 10. In the preferred embodiment and as is best shown in FIG. 3, the pressure gauge 30 communicates with the hollow interior 14 of club head 2 via a narrow passageway 34 through the club head. Typically, the pressure gauge 30 will be responsive to and provide a visual indication of pressure lying in a range of pressures between one to ten pounds. Thus, the golfer can acquire different clubs having different pressures to account for a variety of playing situations that are commonly encountered along a golf course.

Whether or not the hollow club head 2 of golf club 1 is provided with a pressure gauge, it may be desirable for the club head 2 to include a pressure relief valve 36 so as to avoid over-pressurized conditions with the possibility that the club head could explode during impact and cause injury to the golfer and/or others. By way of example, the pressure relief valve 36 is a one-piece rubber plug that is located at an opening in the head of the club head 2 (best shown in FIG. 3). The illustrated valve 36 has a normally closed slit or channel 38 that is adapted to open at a predetermined pressure above the ideal pressure of club head 2, whereby the hollow interior 14 of club head 2 will communicate with the atmosphere until the pressure within the head has been reduced to a safe level.

Figure 4:
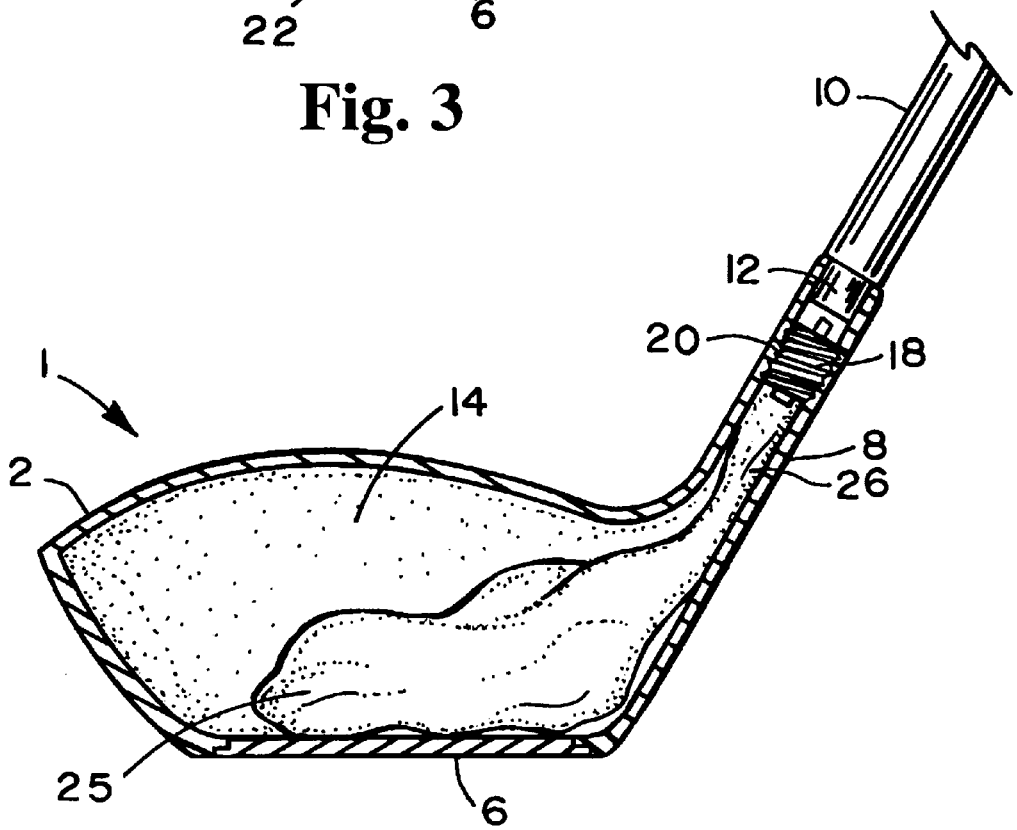
FIG. 4 is a cross section of the golf club of FIG. 2 having an inflatable balloon located at the hollow head thereof to be inflated by a supply of air under pressure.

As an alternative to covering the hollow interior 14 of club head 2 with the sealer 22 of FIG. 3, and referring to FIG. 4 of the drawings, an inflatable balloon 25 may be housed in club head 2. The inflatable balloon 25 is manufactured from a relatively thick elastomeric material that is sufficiently flexible so as to be inflated to conform to the shape of the club head 2 and sufficiently strong to avoid degradation over time. The balloon 25 is located at hollow interior 14 of club head 2 in the uninflated condition. The balloon 25 is disposed within the club head 2 via the bottom of the club head prior to affixing the sole plate 6 or via the hollow hosel 8 prior to attaching the air valve 18.

In either event, an open neck 26 of balloon 25 is coupled to the air valve 18 by way of the bottom end of hosel 8. Thus, the balloon 25 will be inflated when fluid (e.g. air) under pressure is delivered to the normally closed air valve 18 to cause the valve to be momentarily opened. When the club head 2 is filled with air to the desired pressure and the balloon 25 is correspondingly inflated, the air valve 18 is allowed to close so that the shaft 10 can be connected to the top end of the hosel 8 for completing the assembly of golf club 1. However, as may now be appreciated, the balloon 25 will function as an envelope to be filled with air while preventing such air from easily escaping from the club head 2 into the atmosphere.

By virtue of the foregoing, the hollow driving head 2 of a metal/wood golf club 1 will be filled with air under pressure to make the head less susceptible to being compressed during its impact with a golf ball. Accordingly, a harder striking force will be imparted to the golf ball to enable the golfer to drive the ball a relatively longer distance. Hence, the golfer is provided with the benefits of using a golf club that is manufactured from a strong but light weight metallic material and characterized by the ability to hit the ball further than traditional metal/wood clubs.

It will be apparent that while a preferred embodiment of the invention has been shown and described, various modifications and changes may be made without departing from the true spirit and scope of the invention. For example, it is to be understood that the fluid with which the hollow interior 14 of club head 2 is filled may be either a liquid or a gas. In the preferred embodiment of the invention, the club head 2 is filled with air, under pressure. What is more, instead of using a threaded tire valve 18 to fill the club head 2 with air, a solid plug that is manufactured from a flexible self-sealing material may be pushed into the hosel 8 to prevent the escape of the air 16 from that hollow interior 14 of club head 2. In this case, a hollow needle would penetrate the plug to deliver air under pressure to the club head 2.

Having thus set forth a preferred embodiment of this invention, what is claimed is:

1. A golf club comprising:

a club head having a hollow interior and a hollow hosel attached to the club head, said hollow hosel having a first set of screw threads;

a shaft detachably connected to the club head at the hosel;

a normally closed fluid valve communicating with the hollow interior of the club head and having a second set of screw threads extending therearound, such that said normally closed fluid valve is positioned within said hollow hosel with said first and second sets of screw threads being mated together, said normally closed fluid valve being momentarily opened to permit the club head to be filled with a fluid under pressure, said fluid under pressure being sufficient to prevent the compression of the club head in response to the club head striking a golf ball during the stroke of a golfer; and a pressure gauge communicating with the hollow interior of the club head to provide an indication of the fluid pressure therewithin.

2. The golf club recited in claim 1, wherein said fluid under pressure is a gas.

3. The golf club recited in claim 2, wherein said gas is compressed air.

4. The golf club recited in claim 1, wherein said golf club is a metal/wood driver.

5. The golf club recited in claim 1, including a sealer surrounding the hollow interior of the club head to prevent said fluid under pressure from leaking out of the hollow interior.

6. The golf club recited in claim 1, wherein said pressure gauge communicates with the hollow interior of the club head via a passageway through the club head.

7. The golf club recited in claim 1, also comprising an inflatable balloon located at the hollow interior of the club head to receive said fluid under pressure by way of the hollow hosel when said normally closed fluid valve is momentarily opened, whereby said balloon is inflated to prevent the escape of said fluid under pressure from the hollow interior.

8. The golf club recited in claim 7, wherein said balloon has an open neck coupled to said normally closed fluid valve, said balloon being inflated with said fluid under pressure by way of the hollow hosel, said fluid valve, and the neck of said balloon when said normally closed fluid valve is momentarily opened.

9. The golf club recited in claim 7, also comprising an opening formed in the club head and communicating with the hollow interior thereof, said inflatable balloon being located at the hollow interior of the club head via said opening, and a sole plate connected to the club head to close said opening after said inflatable balloon is located at the hollow interior.

10. The golf club recited in claim 1, also comprising a pressure relief valve communicating with the hollow interior of the club head to relieve over-pressurized conditions within said club head.

11. A golf club comprising:

a club head having a hollow interior and a hollow hosel attached to the club head;

a shaft detachably connected to the club head at the hosel;

a normally closed fluid valve communicating with the hollow interior of the club head, said normally closed fluid valve being momentarily opened to permit the club head to be filled with a fluid under pressure, said fluid under pressure being sufficient to prevent the compression of the club head in response to the club head striking a golf ball during the stroke of a golfer;

a pressure gauge communicating with the hollow interior of the club head to provide an indication of the fluid pressure therewithin; and an inflatable balloon located at the hollow interior of the club head to receive said fluid under pressure and thereby prevent the escape of said fluid under pressure from the hollow interior, said balloon having an open neck coupled to said normally closed fluid valve, whereby said balloon is inflated with said fluid under pressure by way of said normally closed fluid valve and the neck of said balloon when said normally closed fluid valve is momentarily opened.

* * * * *